US011608600B2

(12) United States Patent
Smith et al.

(10) Patent No.: US 11,608,600 B2
(45) Date of Patent: Mar. 21, 2023

(54) WORKING MACHINE

(71) Applicant: J. C. Bamford Excavators Limited, Uttoxeter (GB)

(72) Inventors: Duncan Andrew Smith, Uttoxeter (GB); Patrick Edward Naylor, Uttoxeter (GB)

(73) Assignee: J. C. Bamford Excavators Limited, Uttoxeter (GB)

( * ) Notice: Subject to any disclaimer, the term of this patent is extended or adjusted under 35 U.S.C. 154(b) by 0 days.

(21) Appl. No.: 17/209,197

(22) Filed: Mar. 22, 2021

(65) Prior Publication Data

US 2021/0292980 A1 Sep. 23, 2021

(30) Foreign Application Priority Data

Mar. 23, 2020 (GB) ..... 2004208
Sep. 15, 2020 (GB) ..... 2014522

(51) Int. Cl.
*E01C 23/088* (2006.01)
*E01C 23/12* (2006.01)
(Continued)

(52) U.S. Cl.
CPC ..... *E01C 23/088* (2013.01); *E01C 23/127* (2013.01); *E01C 23/09* (2013.01); *E01H 1/056* (2013.01)

(58) Field of Classification Search
CPC .. E01C 23/09; E01C 23/0946; E01C 23/0993; E01C 23/088; E01C 23/127; E01C 23/0933; E01C 23/096; E01H 1/045; E01H 1/047; E01H 1/056; E01H 3/20; E01H 5/08; E02F 3/20; E02F 5/08
See application file for complete search history.

(56) References Cited

U.S. PATENT DOCUMENTS 3,915,501 A * 10/1975 Cobb ..... E02F 3/962 37/447
4,186,968 A * 2/1980 Barton ..... B28D 1/18 299/39.2

(Continued)

FOREIGN PATENT DOCUMENTS

CN 103276658 A 9/2013
CN 209555843 U 10/2019

(Continued)

OTHER PUBLICATIONS

Search Report for GB2014522.3, dated Jan. 19, 2021.
Search Report for GB2004208.1, dated Aug. 24, 2020.

*Primary Examiner* — Janine M Kreck
*Assistant Examiner* — Michael A Goodwin
(74) *Attorney, Agent, or Firm* — Marshall, Gerstein & Borun LLP

(57) ABSTRACT

A working machine including front and rear wheels or a pair of endless tracks supporting a body. A first working arm with a first implement mount is connected to the body. An apparatus with a collector having a first opening and a sweeper trailing the collector is mounted to the first implement mount. A second implement mount connected to the body, and a milling device is mounted to the second implement mount. The sweeper is configured and arranged to move surface material broken up by the milling device into the collector via the first opening.

6 Claims, 11 Drawing Sheets

(51) Int. Cl.
*E01H 1/05* (2006.01)
*E01C 23/09* (2006.01)

(56) References Cited

U.S. PATENT DOCUMENTS 4,793,732 A * 12/1988 Jordon ..... B28D 1/18 37/403
4,909,575 A * 3/1990 Lupton ..... E01C 23/088 180/24.02
5,203,615 A 4/1993 Zanetis et al.
5,378,081 A * 1/1995 Swisher, Jr. ..... E01C 23/088 299/39.5
5,382,084 A * 1/1995 Diver ..... E01C 23/088 299/39.5
6,266,901 B1 * 7/2001 Kanda ..... B66C 23/84 37/403
6,687,939 B1 * 2/2004 Koester ..... E01H 1/045 15/83
2006/0272184 A1 * 12/2006 Underwood ..... E02F 3/425 37/403
2012/0121330 A1 * 5/2012 Latham ..... E01C 23/088 404/86
2016/0108592 A1 4/2016 Faught, Jr.
2016/0145832 A1 * 5/2016 Stockhaus ..... E02F 3/32 414/815
2017/0073908 A1 * 3/2017 Lee ..... E01C 23/088
2019/0136488 A1 * 5/2019 Cochran ..... E01C 23/096

FOREIGN PATENT DOCUMENTS

DE 2536747 A1 2/1977
DE 4009581 A1 * 10/1991 ..... E01C 19/264
DE 102009060719 A1 * 6/2011 ..... E01H 1/056
GB 2512945 A 10/2014
GB 2564867 A 1/2019
JP H1121838 A * 1/1999
WO WO-2009/114595 A2 9/2009
WO WO-2013/082068 A1 6/2013

* cited by examiner

WORKING MACHINE

FIELD

The present teachings relate to a working machine for removing material from a surface, for example a road surface or a path. The present teachings also relate to an apparatus for removing material from a surface, a kit of parts for removing material from a surface, and to a method of removing material from a surface.

BACKGROUND

Over time and through continued use surfaces, for example road surfaces, paths, playgrounds etc., can become worn and damaged, resulting in the formation of damaged area, commonly referred to as potholes, in the surface. The surface damage may be caused by water weakening the underlying soil structure and traffic passing over the affected area degrading and breaking the poorly supported surface. Alternating cycles of freezing and thawing can also damage the surface. When water enters the surface it can freeze and expand, as the ice thaws it leaves cracks in the surface, subsequently allowing more liquid water into the surface. Eventually, large section of the surface may break away.

Large sums of money are spent each year on routine maintenance and repair of roads to counter this degradation of the surface. The process of repairing such a surface involves planing an area of the surface around the pot hole, removing said planed material so as to prepare the road surface for subsequent deposition of new material into the planed area. Traditional methods for the preparation of an area of a surface for the subsequent deposition of new material are both labor and time intensive.

The present invention seeks to overcome or at least mitigate one or more problems associated with the prior art.

SUMMARY

A first aspect of the teachings provides an apparatus for removing material from a surface to be repaired, the apparatus comprising: a frame defining a leading end and a trailing end in a preferred direction of operation of the apparatus; a milling device connected to the frame and configured to break up a surface, in use; a collector connected to the frame, the collector trailing the milling device in a preferred direction of operation of the apparatus, and having a first opening at or near the trailing end of the frame; and a sweeper connected to the frame, the sweeper trailing the collector in a preferred direction of operation of the apparatus, wherein the sweeper is configured and arranged to sweep surface material broken up by the milling device into the collector via the first opening.

This provides a single apparatus that is able to mill a surface, e.g. a road surface, and to sweep up the loose surface material without requiring multiple different independent components to be used. Moreover, through a single forwards motion of the apparatus, an operator is able machine a surface to break up said surface and to remove the broken or loosened material from said surface. This provides a quick process for the removal of surface material in preparation of further new material being deposited in order to repair a damage to the surface, e.g. a pot hole.

The apparatus may be configured such that the milling device and sweeper are operated simultaneously. This arrangement provides an apparatus that is able to mill a surface and to collect the milled surface material simultaneously, which facilitates quicker machining of a surface to be repaired.

The milling device and sweeper may be configured to be driven by a drive arrangement of a working machine, by a prime mover of a working machine, or by a hydraulic system of a working machine.

The collector and the sweeper may be moveable relative to the milling device. This enables an operator to be able to move the sweeper-collector closer to the ground when it is required, and away from the ground when it is not required. This arrangement has been found to facilitate the correct separate application of the sweeper-collector and the milling device (i.e. to reduce the potential of the milling device engaging the ground during a sweeping operation).

The frame may comprise a first frame part having the milling device connected thereto and a second frame part having the collector and the sweeper connected thereto. The second frame part may be pivotally connected to the first part. Through this pivotal frame arrangement, an operator is able to tilt/move the milling device away from a surface so as to position the sweeper-collector lowermost to enable a sweeping operation to be carried out. The pivotal connection helps to ensure that the sweeper-collector is correctly positioned on a surface during a sweeping operation as the apparatus is lowered onto a surface with the sweeper-collector lowermost.

In a second state of the frame in which the first and second frame parts are rotationally spaced apart, the apparatus is configured such that when the sweeper is in contact with a surface, in use, the milling device is spaced apart from said surface. This arrangement helps to prevent interaction of the milling device occurring during a sweeping process, which has been found to facilitate operation of the apparatus.

The sweeper and the collector may be connected to the frame such that when the sweeper is in contact with a surface, in use, there is a clearance between the collector and said surface. Providing a clearance between the collector and the surface allows the optimum amount of debris to pass under the collector to reach the sweeper during sweeping operation.

The apparatus may comprise a cutting device connected to the frame. The cutting device may define a cutting edge, e.g. a substantially straight cutting edge, for cropping an external perimeter of an area of a surface broken up by the milling device.

The cutting device defines a planar, i.e. straight, cutting edge. The provision of the cutting device enables the area of loosened/removed material to be defined. This also provides an abrupt change between older/existing material and subsequently deposited new surface material, which has been found to improve adhesion and so retention of the new surface material.

The cutting device may be connected to the first frame part.

The cutting device may be mounted to the frame via an actuator. The provision of an actuator, e.g. a hydraulic actuator, enables the force applied to the cutting device to a surface is sufficient to break through said surface.

The cutting device may be pivotally and/or rotatably mounted to the frame. This enables the cutting device to be adjusted to cut around an area of a machined/broken up surface material. This has been found to facilitate operation of the apparatus.

The cutting device may be mounted to the leading end of the frame.

The leading end of the frame may define a leading surface having the cutting device mounted thereto. The leading surface of the frame may be arranged at an acute angle relative to the elongate axis of the frame. This configuration arranges the cutting device at an acute angle relative to the elongate axis of the frame. Put another way, this configuration arranges the cutting device at an acute angle relative to the underside of the apparatus.

During a cutting operation of the apparatus, the apparatus may be rotated such that the cutting device is substantially perpendicular to the surface. The acute angle reduces the rotation of the apparatus required to achieve this perpendicular positioning, whilst ensuring that both the milling device and the sweeper-collector are positioned away from the surface. This has been found to facilitate in the operation of the apparatus.

The milling device and cutting edge may each define a width relative to a direction of preferred operation of the apparatus, and wherein the width of the milling device and cutting edge may be substantially equal.

The cutting device may comprise a chisel mounted to the frame.

The milling device may comprise a planer rotatably connected to the frame.

The milling device may define an elongate axis, and the orientation of said elongate axis of the milling device may be adjustable relative to the frame.

The sweeper may comprise a rotatable sweeper brush.

The sweeper may be adjustably mounted to the frame for changing the position of the sweeper relative to a surface, in use. Providing a sweeper that is movable relative to the frame, e.g. relative to the first opening, has been found to improve the ease of operation of the apparatus. The arrangement enables an operator to move the sweeper towards the ground when it is required, and away from the ground when it is not required. This helps to reduce the potential of the milling device engaging the ground during a sweeping operation.

The apparatus may be portable.

The apparatus may comprise a mounting arrangement for mounting the apparatus to a working machine, e.g. to a working arm of a working machine.

According to a second aspect of the teachings, there is provided a working machine comprising: a body; and a first working arm connected to the body for performing work functions, wherein an apparatus according to the first aspect is mounted to the first working arm.

The body may comprise an undercarriage supported on the ground engaging structure and a superstructure mounted, e.g. rotatably mounted, to the undercarriage. The second implement mount may be connect to the undercarriage. The working arm may be connected to the superstructure.

The apparatus may be configured such that the milling device and sweeper are operated simultaneously.

The milling device and sweeper may be configured to be driven by a drive arrangement of a working machine, by a prime mover of a working machine, or by a hydraulic system of a working machine.

The collector and the sweeper may be moveable relative to the milling device.

The frame may comprise a first frame part having the milling device connected thereto and a second frame part having the collector and the sweeper connected thereto, and wherein the second frame part is pivotally connected to the first part.

The sweeper and the collector may be connected to the frame such that when the sweeper is in contact with a surface, in use, there is a clearance between the collector and said surface.

The working machine may comprise a cutting device connected to the frame, the cutting device defining a cutting edge, e.g. a substantially straight cutting edge, for cropping an external perimeter of an area of a surface broken up by the milling device.

The milling device and cutting edge may each define a width relative to a direction of preferred operation of the apparatus, and wherein the width of the milling device and cutting edge may be substantially equal.

The cutting device may be connected to the first frame part.

The cutting device may be mounted to the frame via an actuator.

The cutting device may be pivotally and/or rotatably mounted to the frame.

The cutting device may be mounted to the leading end of the frame.

The leading end of the frame may define a leading surface having the cutting device mounted thereto, and wherein said leading surface of the frame is arranged at an acute angle relative to the elongate axis of the frame.

The cutting device may comprise a chisel mounted to the frame.

The milling device may comprise a planer rotatably connected to a housing.

The milling device may define an elongate axis, and wherein the orientation of said elongate axis of the milling device is adjustable relative to the frame.

The sweeper may comprise a rotatable sweeper brush, and wherein the sweeper brush is configured and arranged to extend below the collector, optionally to extend below the collector by a distance in the range 60 mm-100 mm, e.g. approximately 80 mm.

The sweeper may be adjustably mounted to the frame for changing the position of the sweeper relative to a surface, in use.

The first implement mount may comprises a hitch, such as a quick hitch or tiltrotator.

According to a third aspect of the teachings, there is provided a working machine comprising: a ground engaging structure provided in the form of front and rear wheels or a pair of endless tracks; a body supported on the ground engaging structure; a first working arm connected to the body for performing work functions, the first working arm comprising a first implement mount at a distal end thereof; a second implement mount connected to the body; a milling device mounted to the second implement mount and configured to break up a surface, in use; and an apparatus mounted to the first implement mount for removing material from a surface, the apparatus comprising a collector having a first opening, and a sweeper trailing the collector in a preferred direction of operation of the apparatus, wherein the sweeper is configured and arranged to move surface material broken up by the milling device into the collector via the first opening.

The body may comprise an undercarriage supported on the ground engaging structure and a superstructure mounted, e.g. rotatably mounted, to the undercarriage. The second implement mount may be connect to the undercarriage. The working arm may be connected to the superstructure.

The second implement mount may comprise a standardized interface configuration, optionally wherein the second implement mount may comprises a skid-steer loader implement interface configuration.

The milling device may be movable laterally along the second implement mount.

The second implement mount may comprise an actuator configured to move the milling device laterally along the second implement mount.

The actuator may be configured to move the milling device along the second implement mount in a direction that is substantially perpendicular to a fore-aft axis of the working machine.

The working machine may comprise a cab in a position offset from the center of the superstructure so as to be positioned proximate a first side of the working machine, and wherein the milling device is moveable, e.g. from a substantially central position, in a direction towards the first side of the working machine.

The second implement mount may be configured and arranged so as to enable the milling device to be moved along the second implement mount so as to extend laterally beyond the ground engaging structure.

The milling device may be able to be positioned by a distance beyond the ground engaging structure in the range 25 mm to 75 mm, e.g. of approximately 50 mm.

The milling device may comprise a housing, and wherein a laterally outer side surface of the housing is substantially planar.

The laterally outer side surface of the housing may be devoid of any surface features.

The undercarriage may comprise a first actuator for raising and lowering the milling device, optionally wherein the second implement mount is configured such that the orientation of the milling device remains substantially constant when raising and lowering said milling device.

The undercarriage may comprise a hydraulic connector for supplying hydraulic fluid to the first actuator to actuate the first actuator.

The undercarriage may comprise a second auxiliary hydraulic connector configured for supplying hydraulic fluid to the milling device.

The apparatus may be mounted to the working arm via a standardized interface configuration.

The standardized interface configuration may be a skid-steer loader implement interface configuration.

A frame may be mounted to the first implement mount, the frame comprising the standardized interface configuration.

A cutting device may be mounted on the first implement mount, the cutting device defining a cutting edge, e.g. a substantially straight cutting edge, for cropping an external perimeter of an area of a surface broken up by the milling device.

The cutting device may be mounted on the frame. The cutting device may be mounted via an actuator.

The cutting device may be adjustably mounted to the first implement mount.

The cutting device may be moveable between a deployed position and a transport position.

The working machine may comprise a locking arrangement to lock the cutting device in the deployed or transport position.

The sweeper may be adjustably mounted to the collector so as to be moveable between a first position for engaging a surface and a second position spaced apart from the first opening.

The sweeper may be connected to collector via an actuator configured to move the sweeper between the first and second positions.

The actuator may comprise a first end fixedly attached to the collector and a second end slideably mounted within an elongate slot on the sweeper.

The superstructure may comprise a first auxiliary hydraulic connector configured to supply hydraulic fluid to the apparatus. The first auxiliary connector may be provided on the working arm.

The working machine may comprise a third implement mount connected to an opposing side of the undercarriage as the second implement mount for operably mounting a working implement to the undercarriage, wherein the undercarriage comprises a second actuator for raising and lowering a working implement when mounted to the third implement mount and comprises a hydraulic connector for supplying hydraulic fluid to the second actuator to actuate the second actuator.

The undercarriage may comprise a third auxiliary hydraulic connector configured for supplying hydraulic fluid to an implement mounted to the third implement mount.

The milling device may define an elongate axis, and wherein the orientation of said elongate axis of the milling device may be adjustable relative to the frame.

The undercarriage may comprise a drive arrangement for moving the ground engaging structure to propel the working machine, the drive arrangement comprising a prime mover and a transmission comprising a hydraulic pump arrangement configured to be driven by the prime mover.

The working machine may comprise an operator's cab rotatably mounted on the superstructure, e.g. rotatable by a rotary connection, wherein the superstructure is rotatable about a first generally upright axis and the operator's cab is rotatable about a second generally upright axis.

An entirety of the drive arrangement may be positioned below a level coincident with a lower extent of the superstructure.

The working machine may comprise a counterweight provided on the superstructure, the counterweight having a mass for counterbalancing the working arm.

The counterweight may be formed as a single unitary component, for example a cast iron or steel component.

The collector and the sweeper may be moveable relative to the milling device, optionally wherein the frame comprises a first frame part having the milling device connected thereto and a second frame part having the collector and the sweeper connected thereto, and wherein the second frame part is pivotally connected to the first part.

The sweeper and the collector may be connected to the frame such that when the sweeper is in contact with a surface, in use, there is a clearance between the collector and said surface.

The cutting device may comprise a chisel mounted to the frame.

The milling device may comprise a planer rotatably connected to a housing.

The milling device may define an elongate axis, and wherein the orientation of said elongate axis of the milling device is adjustable relative to the frame.

The sweeper may comprise a rotatable sweeper brush, and wherein the sweeper brush is configured and arranged to extend below the collector, optionally to extend below the collector by a distance in the range 60 mm-100 mm, e.g. approximately 80 mm.

The sweeper may be adjustably mounted to the frame for changing the position of the sweeper relative to a surface, in use.

The first implement mount may comprise a hitch, such as a quick hitch or tiltrotator.

According to a fourth aspect of the teachings there is provided a kit of parts for a working machine comprising: a milling device mounted to the second implement mount and configured to break up a surface, in use; and an apparatus for removing material from a surface and configured to be mounted to a working arm of a working machine, the apparatus comprising a collector having a first opening, and a sweeper trailing the collector in a preferred direction of operation of the apparatus, wherein the sweeper is configured and arranged to sweep surface material broken up by the milling device into the collector via the first opening.

The kit of parts of the fourth aspect may have any feature or any combination of features from the first, second and third aspects.

According to a further aspect of the teachings, there is provided a method of removing material from a surface to be repaired using an apparatus according to the first aspect or a working machine according to the second aspect or the third aspect, or a kit of parts according to the fourth aspect, the method comprising the steps of: a) breaking up a surface material with a milling device; and b) sweeping the broken up surface material into the collector.

Step a) and step b) may be carried out simultaneously.

The method may further comprise step c) of cutting the perimeter of the area of the surface broken up by the milling device in step a).

The method may further comprise step d) of pivoting the milling device away from the surface and sweeping the broken up surface material into the collector.

BRIEF DESCRIPTION OF THE DRAWINGS

Embodiments will now be described with reference to the accompanying drawings, in which.

DETAILED DESCRIPTION OF EMBODIMENT(S)

Figure 1:
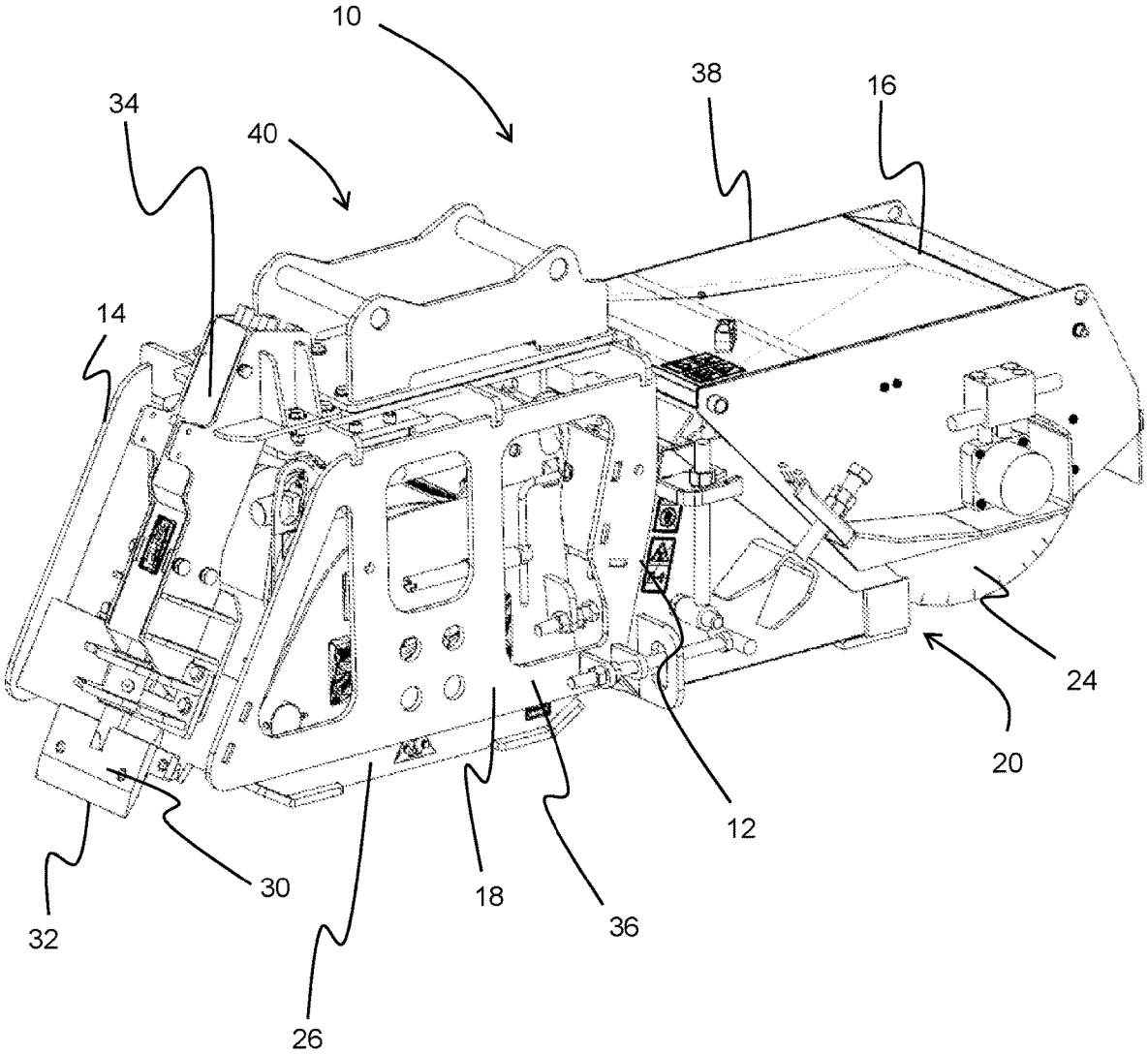
FIG. 1 is a schematic isometric view of an apparatus according to an embodiment.
Figure 2:
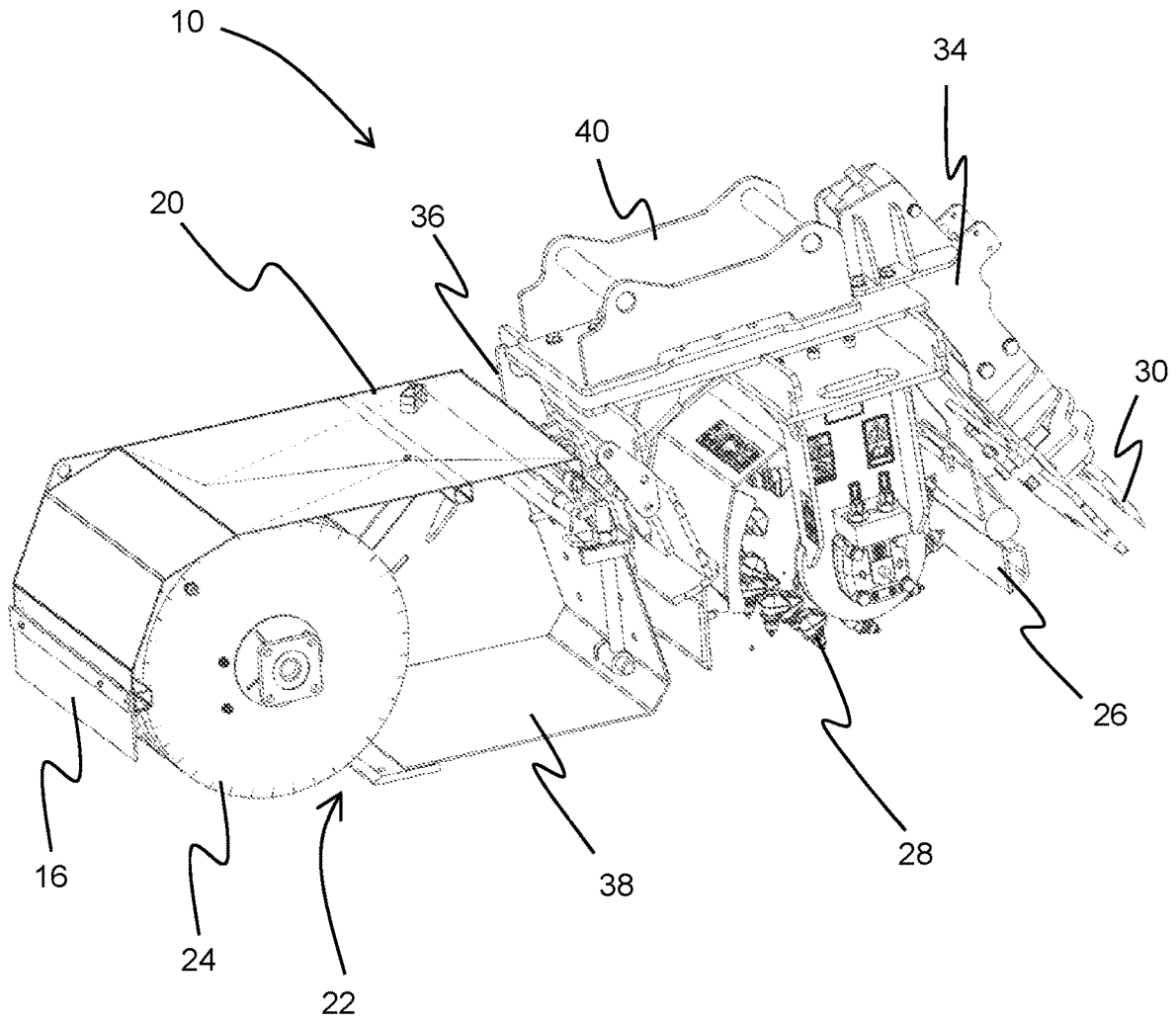
FIG. 2 is a schematic partially cutaway isometric view of the apparatus of FIG. 1.
Figure 3:
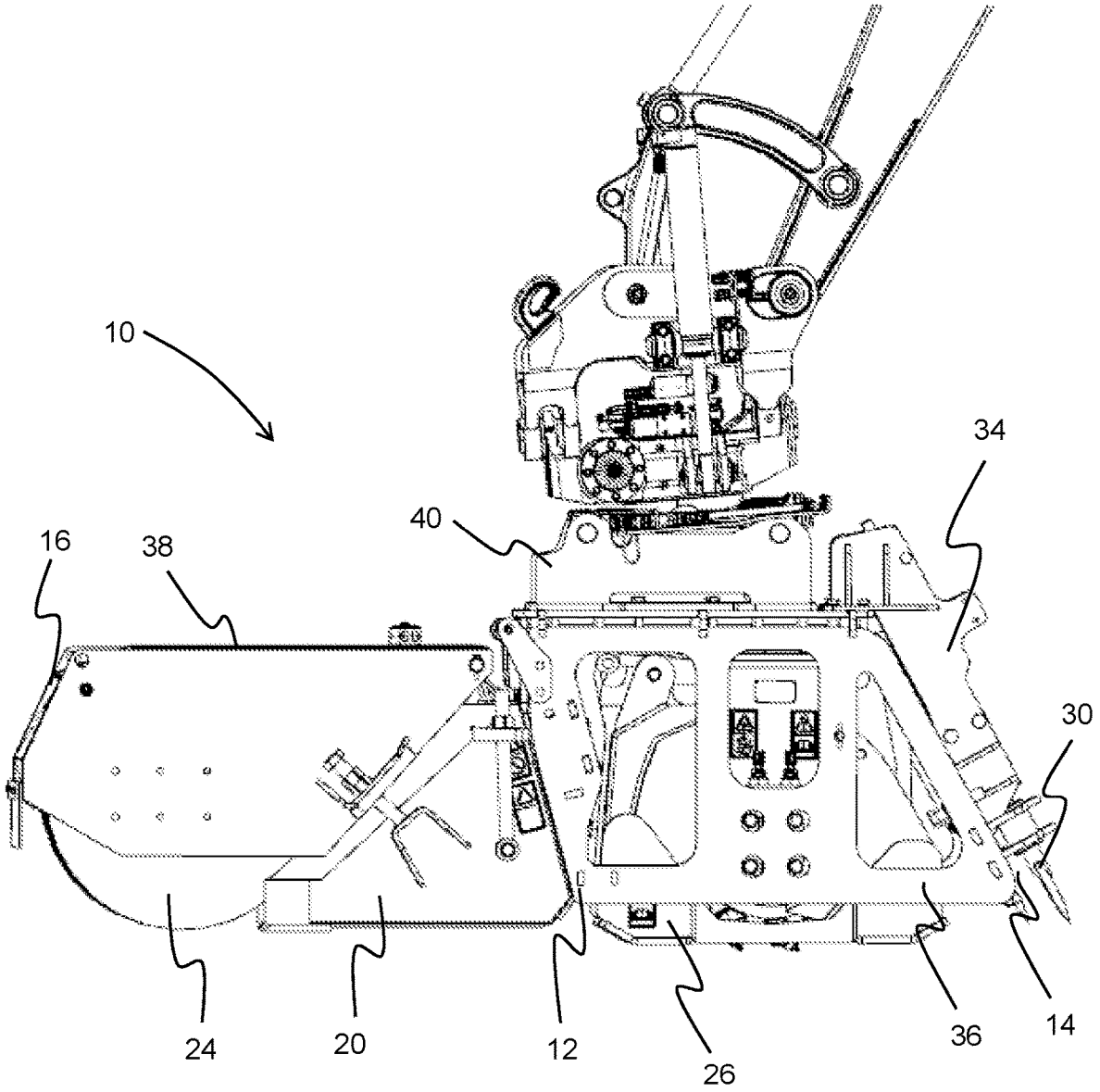
FIG. 3 is a schematic side view of the apparatus of FIG. 1.
Figure 4:
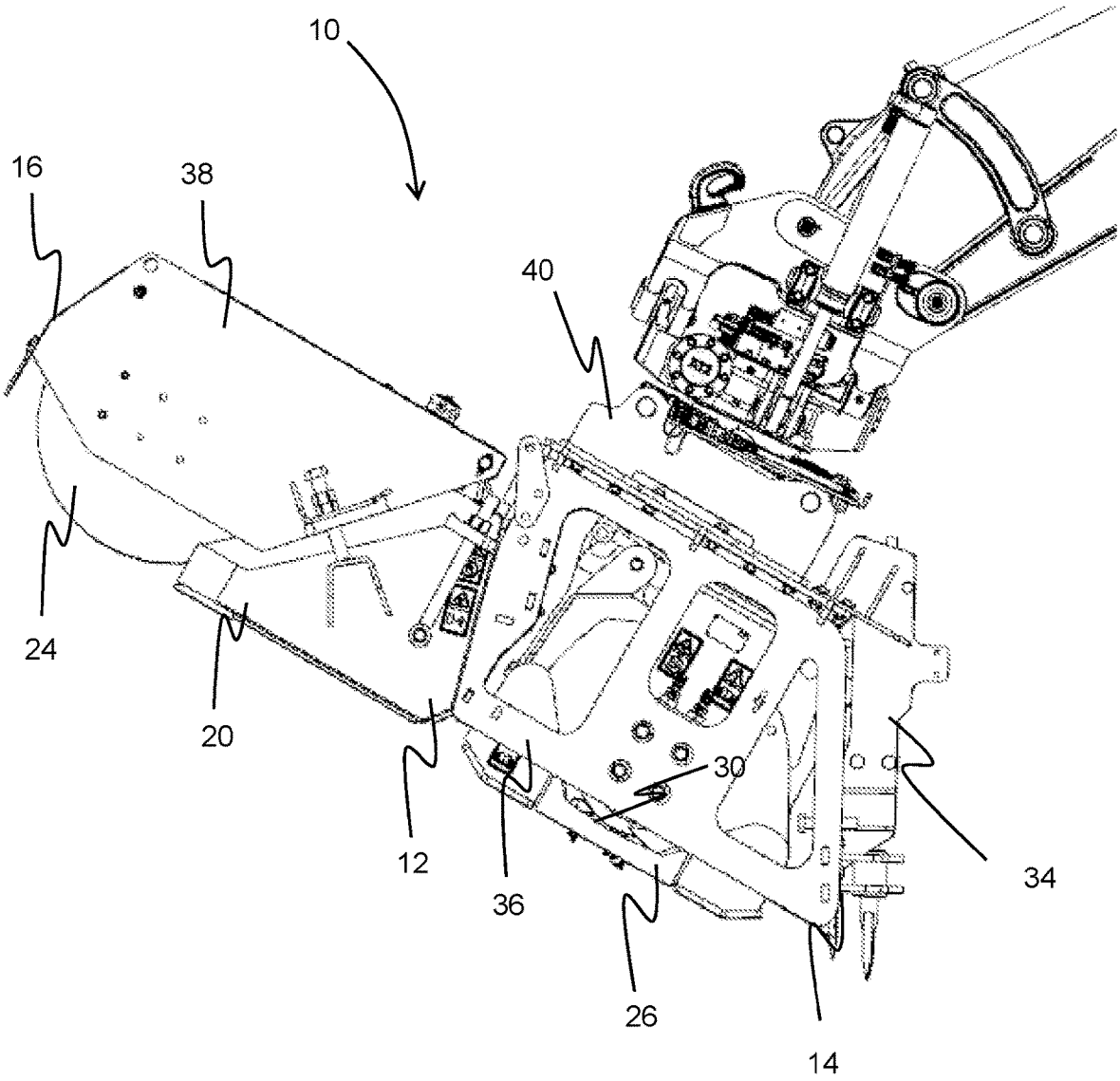
FIG. 4 is a schematic side view of the apparatus of FIG. 1.
Figure 5:
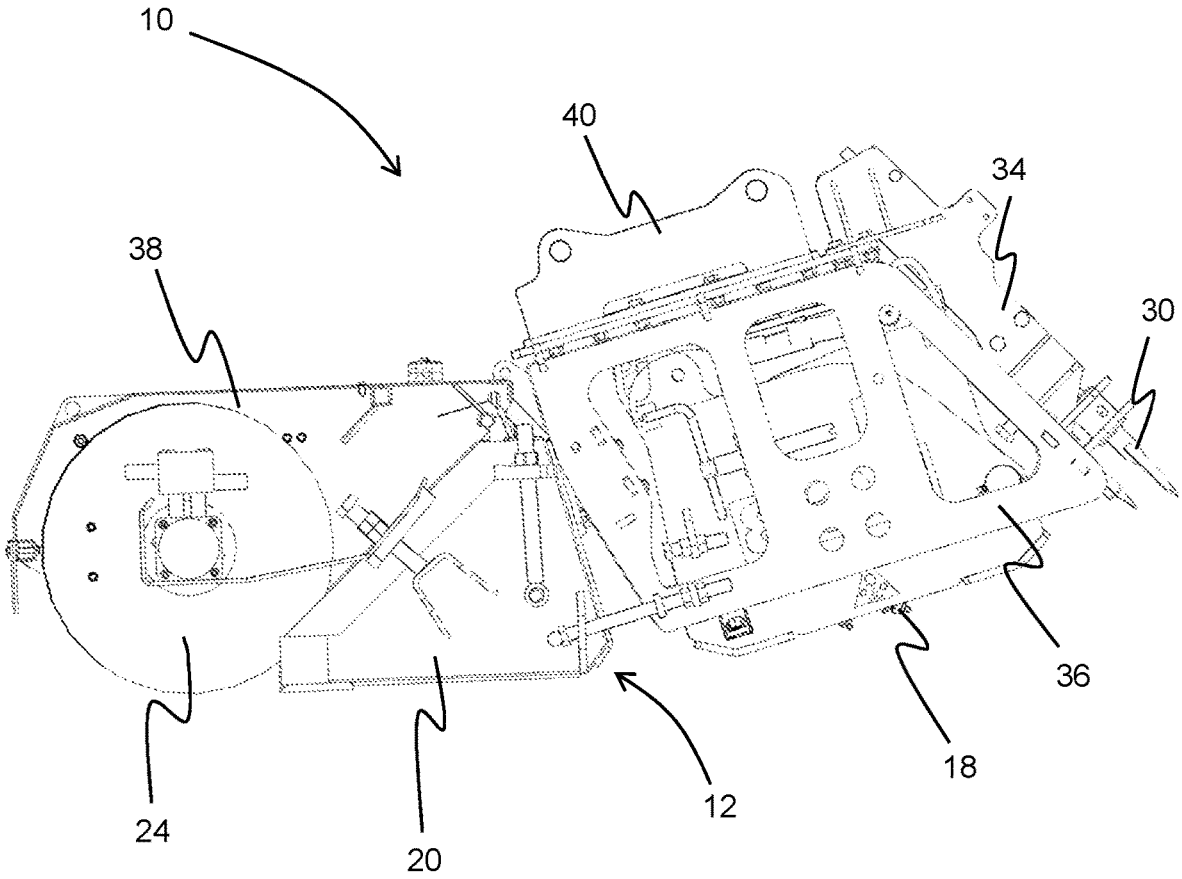
FIG. 5 is a schematic side view of the apparatus of FIG. 1.
Figure 6:
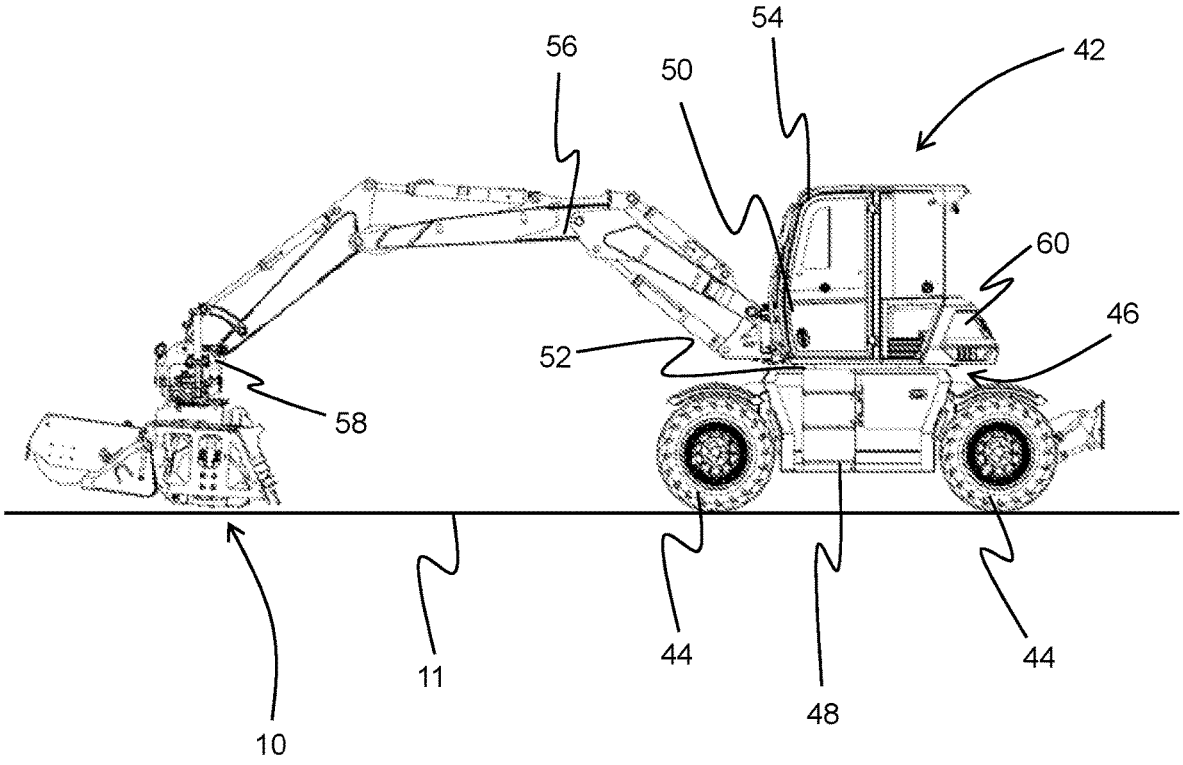
FIG. 6 is a schematic side view of a working machine according to an embodiment.

Referring firstly to FIGS. 1 to 5, an apparatus 10 for removing material from a surface 11 (as illustrated in FIG. 6) that is to be repaired is illustrated. The surface 11 may be a road surfaces, a path, a playgrounds etc. or any other highway or off-highway surface. The apparatus 10 is provided to machine an area of the surface 11 surrounding a damaged area, also known as a pot hole, in preparation for new material to be deposited thereon.

The apparatus 10 includes a frame 12 defining a leading (i.e. a front) end 14 and a trailing (i.e. rear) end 16 in a preferred direction of operation of the apparatus 10. A milling device 18 is connected to the frame 12. A collector 20 is connected to the frame 12.

The milling device 18 and collector 20 are arranged on the frame 12 such that the milling device 18 is in front of the collector 20 (i.e. the collector 20 is positioned rearward of the milling device 18 on the frame 12) in a preferred direction of operation of the apparatus 10. The collector 20 is arranged to trail the milling device 18 in a preferred direction of operation. Put another way, the milling device 18 is closer to the leading end 14 of the frame 12 than the collector 20.

The collector 20 defines a first opening 22 at or near the trailing end of the frame 12 for receiving material/debris therein. A sweeper 24 is connected to the frame 12. The sweeper 24 is positioned to trail the collector 20 in a preferred direction of operation of the apparatus 10 (i.e. the sweeper 24 is positioned rearward of the collector 20 on the frame 12). The sweeper 24 is configured and arranged to sweep material of a surface broken up by the milling device 18 into the collector 20 via the first opening 22.

The milling device is configured for breaking up, e.g. milling, a surface 11 to loosen a surface 11. It will be appreciated that the planer 18 may be configured to break up a surface 11 down to a depth of approximately 40 mm, or down to a depth of approximately 120 mm, or down to a depth of approximately 160 mm, as required. When the surface 11 has been broken up by the planer 18, the loose surface material is left in place as loose debris. The loose material is subsequently collected, as is discussed in more detail below.

In the arrangement shown, the milling device 18 is provided in the form of a planer. The planer 18 includes a planer housing 26 and a milling drum 28 for breaking up the surface 11. It will be appreciated that in alternative arrangements, any device suitable for breaking up the surface 11 may be used.

The milling device 18 defines an elongate axis that is illustrated as being substantially perpendicular to the elongate axis of the apparatus 10. It will be appreciated that the milling device 18 may be mounted to the frame 12 such that the elongate axis of the milling device pivotable/adjustable relative to the elongate axis of the frame 12. Put another way, it will be appreciated that the milling device 18 may be connected to the frame 12 such that it is able to swivel relative to the frame 12.

As is discussed above, the loose material of the surface 11 broken up by the milling device 18 is swept up by the sweeper 24. The sweeper 24 is provided as a sweeper brush 24 that is rotatably mounted to the frame 12. The sweeper 24 may be adjustably mounted to the frame 12. This mounting arrangement may enable the position of the sweeper 24 relative to the surface 11 to be adjusted, e.g. by an operator. The mounting arrangement may enable the position of the sweeper 24 relative to the milling device 18 to be adjusted, e.g. by an operator.

The apparatus 10 may be configured such that the milling device 18 and sweeper 24 are operated simultaneously. In the arrangement shown, the milling device 18 and sweeper 24 are driven simultaneously via hydraulic fluid. This arrangement provides an apparatus that is able to mill a surface and to collect the milled surface material simultaneously, which facilitates quicker machining of a surface to be repaired. In alternative arrangements, the milling device 18 and/or sweeper may be driven by the drive arrangement of a working machine, by a prime mover, e.g. via a chain drive or any other suitable drive arrangement. In further alternative arrangements, only one of the milling device 18 or sweeper 24 may be driven, and the milling device 18 and sweeper 24 may be connected via a drive belt. Such a drive belt enables rotational movement to be transferred from the milling device 18 to the sweeper or from the sweeper 24 to the milling device 18.

The apparatus 10 of the present teachings provides a single unit that is able to break up an area of a surface 11, e.g. a damaged area of a surface, and to sweep up the loose surface material. Moreover, the relative positions of the milling device 18, the collector 20 and the sweeper 24 enable this process to be carried out in a single movement of the apparatus 10.

The apparatus 10 is provided with a cutting device 30 mounted to the frame 12. The cutting device 30 defines a substantially straight cutting edge 32. This substantially straight cutting edge 32 is provided for cropping an external perimeter of the area of a surface 11 broken up by the milling device 18. Put another way, the cutting device 30 defines a substantially straight cutting or cropping edge 32. In the arrangement, shown the cutting device 30 is provided in the form of a chisel mounted to the frame 12, but it will be appreciated that in alternative arrangements any suitable cutting tool may be used to suit the application.

Use of the cutting device 30 enables an operator to provide a defined edge to the area the surface 11 that has been machined. The provision of a defined boundary (e.g. a substantially upright boundary) between older/existing material and subsequently deposited new surface material has been found to improve retention of the new surface material.

The width of the cutting device 30 may be provided so as to substantially match the width of the milling device 18 (e.g. of the milling drum 28 of the milling device 18). This arrangement enables the entire width of the area of the surface 11 that is machined by the milling device 18 to be cropped with the cutting device 30 in a single step. This has been found to facilitate the removal of material from a surface by an operator, and helps to reduce the time required to carry out this removal of machine a surface material. In some alternative arrangements, it will be appreciated that the width of the cutting deice 30 may be wider or narrower than the width of the milling device 18.

The cutting device 30 is mounted to the frame 12 via an actuator 34. The actuator 34 is configured and arranged to move the cutting device 30 towards the surface 11 with sufficient force to break through the surface 11. In alternative arrangements, the actuator may not be provided and the cutting device 30 may be directly connected to the frame 12. In such alternative arrangements, it will be appreciated that the apparatus may be driven towards a surface 11, e.g. by a working arm of a working machine, so as to crop an external perimeter of the area of a surface 11 broken up by the milling device 18.

The cutting device 30 is mounted to the leading end 14 of the frame 12. The leading end 14 of the frame 12 defines a leading surface having the cutting device 30 mounted thereto. The leading end/leading surface 14 of the frame 12 is arranged at an acute angle relative to the elongate axis of the frame 12 (i.e. to the surface 11, in use). Put another way, the leading end/leading surface 14 of the frame 12 is arranged so as to position the cutting device 30 at an acute angle relative to the surface 11, when the milling device 18 is positioned on said surface 11.

This arrangement of the cutting device 30 requires the apparatus 10 to be rotated to position the cutting device 30 perpendicular to the surface 11. This rotation, helps to ensure that when the cutting device 30 is in operation, the milling device 18, the collector 20 and the sweeper 24 are positioned away from said surface 11.

Although not illustrated, the cutting device 30 may be pivotally and/or rotatably mounted to the frame 12. This pivotal and/or rotational mounting may be used to enable the position of the cutting device 30 to be adjusted relative to the frame 12, e.g. to cut around a perimeter of area of the surface 11 that has been broken up.

The frame 12 includes a first frame part 36 and a second frame part 38. The second frame part 38 is pivotable relative to the first frame part 36. In the illustrated arrangement, the milling device 18 is connected to the first frame part 36, and the sweeper 24 and collector 20 are connected to the second frame part 38. It will be understood that the cutting device 30 is mounted to the first frame part 36 (i.e. to the front face 14 of the first frame part 36). The cutting device 30 is mounted to the leading edge of the first frame part 36. Through this pivotal arrangement of the first and second frame parts 36, 38, the milling device 18 is able to be moved, e.g. pivoted, away from the sweeper 24 and collector 20. Put another way, the frame 12 is configured and arranged such that the sweeper 24 and collector 20 are able to pivot away from the milling device 18.

In a first state of the frame 12 (shown in FIG. 3), the first and second frame parts 36, 38 are arranged to be in-line (i.e. the first and second frame parts 36, 38 are not rotationally offset).

During a cutting operation of the apparatus 10 (shown in FIG. 4), the apparatus 10 is rotated about the leading end 14 of the frame 12. During such a cutting operation, the first and second parts 36, 38 of the frame 12 remain in the first state. The apparatus 10 is rotated such that the cutting device 30 is arranged to be substantially perpendicular to the surface 11. As discussed above, this rotation of the apparatus 10 moves the milling device 18, collector 20 and sweeper 24 away from the surface 11. This helps to facilitate the machining and removal of surface material, by preventing other components of the apparatus 10 from contacting a surface during a cutting operation.

In a second state of the frame 12 (shown in FIG. 5), the first and second frame parts 36, 38 are rotationally offset from each other. In this second state of the frame 12, the apparatus 10 is configured such that when the sweeper 24 is in contact with the surface 11, the milling device 18 is spaced apart from said surface 11. In the second state of the frame 12, the cutting device 30 is spaced apart from the surface 11.

During a sweeping operation, the apparatus 10 is rotated about the trailing end 16 of the frame 12. The apparatus 10 is rotated such that the sweeper 24 and collector 20 are lowermost on the apparatus 10. Put another way, in the second state of the frame 12, the sweeper 24 and the collector 20 are arranged that when the sweeper 24 is in contact with the surface 11, there is a clearance between the collector 20 and said surface 11

In the illustrated arrangement, when the sweeper 24 is lowered onto the surface 11, the surface 11 causes the second part 38 of the frame 12 to pivot away from the first part 36 of the frame 12. In alternative arrangements, the apparatus 10 may include an actuator to move the frame 12 between the first and second states.

The apparatus 10 is intended to be portable, meaning that an operator is able to transport the apparatus 10 to the location of the surface 11 to be repaired. The apparatus 10 includes a mounting arrangement 40 for mounting the apparatus 10 to a working machine (as is shown in FIG. 6). In alternative arrangements, the apparatus 10 may not include the mounting arrangement 40 and instead may be moveable, for example on wheels, and transported to the location of the surface 11 on a trailer or by other such means.

Referring to FIG. 6, there is illustrated a working machine 42. In the present embodiment, the working machine 42 may be considered to be an excavator. The working machine 42 could be any type of working machine such as an excavator having any operating weight, a loader, a dumper, a forklift, a telehandler etc.

The working machine 42 includes a ground engaging propulsion arrangement in the form of front and rear wheels 44. In alternative arrangements, the ground engaging propulsion arrangement may be provided in the form of a pair of endless tracks. The working machine 42 includes a drive arrangement (not shown) for providing motive power to the ground engaging propulsion system. The drive arrangement may comprise a prime mover and a transmission. The transmission may include a hydraulic pump arrangement configured to be driven by the prime mover. An entirety of the drive arrangement may be positioned below a level coincident with a lower extent of the superstructure.

The working machine 42 has a body 46 supported on the ground engaging propulsion arrangement. The working machine 42 includes an undercarriage 48 supported on the ground engaging propulsion arrangement. A superstructure 50 is connected to the undercarriage 48. The superstructure 50 is connected to the undercarriage 48 by a mounting arrangement 52.

In the arrangement shown, the mounting arrangement 52 is a slewing mechanism in the form of a slewing ring. The mounting arrangement 52 permits unrestricted rotation of the superstructure 50 relative to the undercarriage 48 in this embodiment. In alternative arrangements it will be appreciated that the superstructure 50 may not be able to rotate relative to the undercarriage 48.

A cab 54 from which an operator can operate the working machine 42 is mounted to the superstructure 50. The cab 54 includes an operator seat (not shown). It will be appreciated that in some arrangements, the working machine 42 may not include a cab 54 and the operator seat may be directly connected on the working machine 42.

The working machine 42 includes a working arm 56. The working arm 56 is connected to the body 46 and is provided for performing working operations. In the arrangement shown, the working arm 56 is connected to the superstructure 50. The working machine 42 includes a counterweight 60 having a mass for counterbalancing the working arm 56. The counterweight 60 is provided on the superstructure 50. In alternative arrangements, it will be appreciated that the counterweight may be omitted.

An apparatus 10 for removing material from a surface 11 that is to be repaired is mounted to the working arm 56. The working arm 56 is configured to connect to the mounting arrangement 40 of the apparatus 10. In the illustrated arrangement, the working arm 56 includes a hitch for securing the apparatus 10 onto the working arm 56. In the illustrated arrangement, the hitch is provided in the form of a tiltrotator 58, and the apparatus 10 connects to the tiltrotator 58. In alternative arrangements, a different attachment arrangement may be provided to connect the working arm 56 to the mounting arrangement 40 of the apparatus 10, e.g. via an alternative hitch or via a direct connection.

Operation of the apparatus 10 will now be discussed.

The portable apparatus 10 is transported to the location of the surface 11 that is to be repaired by an operator. In the illustrated arrangement, the apparatus 10 is connected to a working machine 42 and is transported to the required location by said working machine 42. It will be appreciated that in alternative arrangements, the apparatus 10 may be transported to the required location on a trailer or other suitable means.

The apparatus is lowered onto the surface 11 with the milling device 18 positioned lowermost. The apparatus 10 is moved over a surface 11. Using the milling device 18, the material of the surface 11 to be repaired is broken up (i.e. loosened) down to a required depth. During this milling process, it will be appreciated that the sweeper 24 is also being operated such that the loosened surface material is continually being swept into the collector 20.

Following the milling operation, and a cutting operation is carried out by the apparatus 10. The apparatus 10 is rotated (e.g. about the leading end 14 of the frame 12) such that the cutting device 30 is arranged to be substantially perpendicular to the surface 11. This positioning of the apparatus moves the milling device 18, collector 20 and sweeper 24 away from the surface 11. The apparatus 10 is lowered towards the surface 11, and engages said surface.

The cutting device 30 carries out a cutting operation 11 to crop the area of the surface broken up by the milling device 18. It will be appreciated that this cutting operation may be carried out with the assistance of the actuator 34, or if the actuator 34 is not provided, the cutting operation may be carried out by lowering, e.g. driving, the cutting device 30 towards the surface 11. Rotation of the apparatus 10 about the leading end 14 also works to move the material in the collector 20 away from the opening 22.

Following the cutting operation, an operator carries out a sweeping operation with the apparatus 10. The apparatus 10 is rotated (e.g. about the trailing end 16 of the frame 12) such that the sweeper 24 and collector 20 are lowermost on the apparatus 10. This rotation of the apparatus 10 moves the milling device 18 away from the surface 11. The second part 34 of the frame 12 is then pivoted away from the first part 32 of the frame 12, and the sweeper 24 is in contact with the surface 11. It will be appreciated that the sweeper 24 and the collector 20 are arranged that when the sweeper 24 is in contact with the surface 11, there is a clearance between the collector 20 and said surface 11. It will further be appreciated that the pivotal movement between the first and second parts 32, 34 of the frame 12 may be carried out by abutting the sweeper 24 against the surface 11 or via an actuator (not shown). The sweeper 24 is then operated so as to sweep the broken-up material of the surface 11 into the collector 20.

After this sweeping process has been completed, the apparatus 10 may then be moved to a skip or other such container and be rotated about the trailing end 16 of the frame 12 so as to empty the material from the collector 20.

Whilst not illustrated, it will be appreciated that the apparatus 10 may be provided with a dust suppression arrangement. As an example, this may be provided in the form of a water tank mounted on the apparatus 10 along with a pump to dispense water from a nozzle (e.g. in the form of a spray nozzle or dribble bars). The nozzle may be provided on the sweeper 24. It will be appreciated that the water tank and water pump may be positioned on the working machine.

Figure 7:
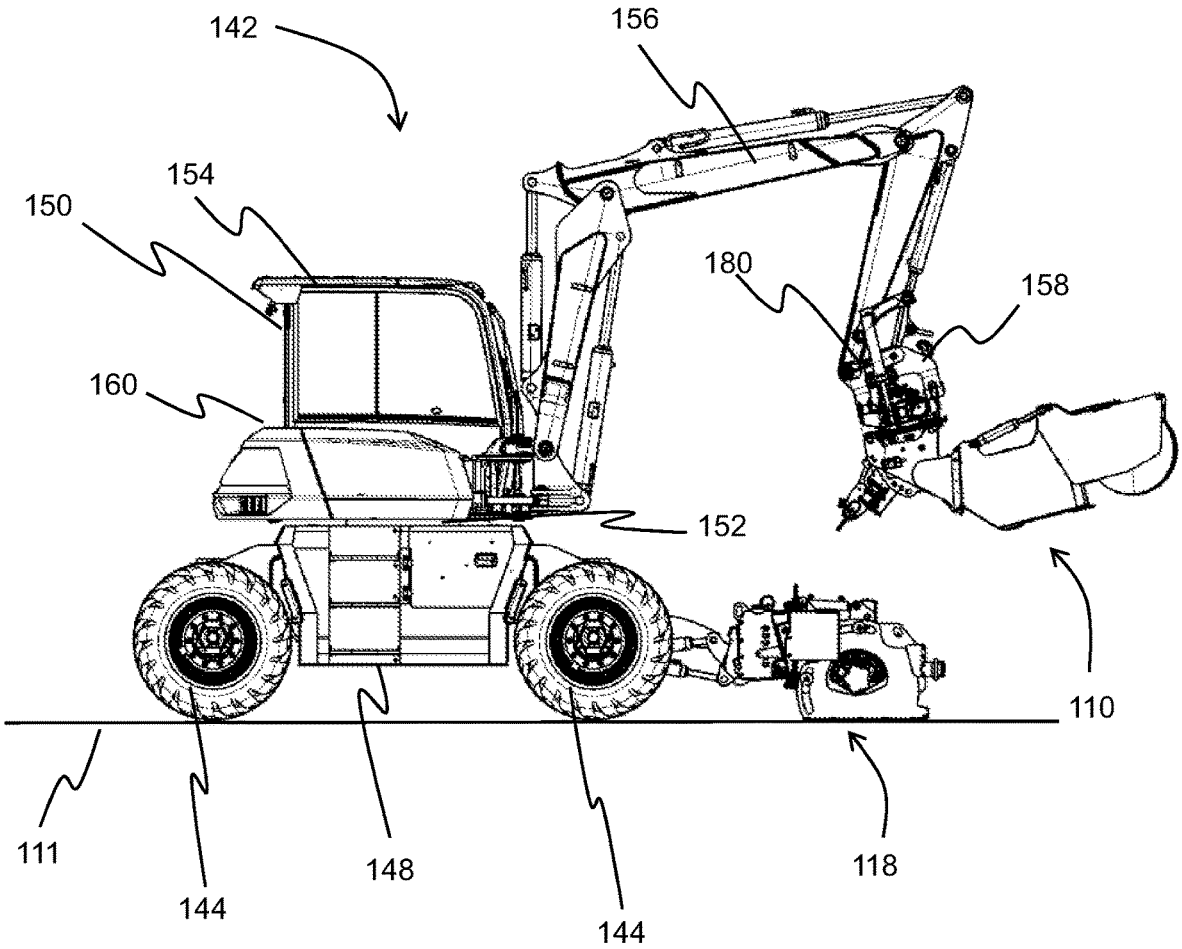
FIG. 7 is a schematic side view of a working machine according to an embodiment.

Referring to FIG. 7, there is illustrated a working machine 142 according to an embodiment. Like features with respect to FIG. 6 are labelled with the prefix "1", and only differences are discussed.

The working machine 142 may be considered to be an excavator. The working machine 142 could be any type of working machine such as an excavator having any operating weight, a loader, a dumper, a forklift, a telehandler etc. The working machine 142 includes a ground engaging propulsion arrangement in the form of front and rear wheels 44. In alternative arrangements, the ground engaging propulsion arrangement may be provided in the form of a pair of endless tracks.

The working machine 142 includes a drive arrangement (not shown) for providing motive power to the ground engaging propulsion system. The drive arrangement may comprise a prime mover and a transmission. The transmission may include a hydraulic pump arrangement configured to be driven by the prime mover. An entirety of the drive arrangement may be positioned below a level coincident with a lower extent of the superstructure 150.

The working machine 142 has a body 146 supported on the ground engaging propulsion system. In some arrangements, the body 146 includes an undercarriage 148 supported on the ground engaging propulsion system and a superstructure 150 connected to the undercarriage 148. In alternative arrangements, the working machine 142 may not include an undercarriage 148 and superstructure 150.

The superstructure 150 is connected to the undercarriage 148 by a mounting arrangement 152. In the arrangement shown, the mounting arrangement 152 is a slewing mechanism in the form of a slewing ring. The mounting arrangement 152 permits unrestricted rotation of the superstructure 150 relative to the undercarriage 148 in this embodiment. In alternative arrangements it will be appreciated that the superstructure 150 may not be able to rotate relative to the undercarriage 148.

A cab 154 from which an operator can operate the working machine 142 is mounted to the superstructure 150. The cab 154 includes an operator seat (not shown). It will be appreciated that in some arrangements, the working machine 142 may not include a cab 154 and the operator seat may be directly connected on the working machine 142. The superstructure 150 mounts the cab 154 offset to one side of the undercarriage 148 in a lateral direction L.

The working machine 142 includes a working arm 156. The working arm 156 is connected to the body 46 and is provided for performing working operations. In the arrangement shown, the working arm 156 is connected to the superstructure 150. The working arm 156 is mounted to the superstructure 150, e.g. using a kingpost arrangement, so as to be capable of pivoting relative to the superstructure 150 about a vertical axis. The working arm 156 may be a working arm of an excavator (a boom) to be operated in conjunction with a dipper arm having an attachment mounted thereon. Preferably, the kingpost may be proximate the front of the working machine 142.

Provision of a working arm 156 rotatable relative to the superstructure 150 about a generally upright axis advantageously further improves the versatility of the working machine 142, and the visibility for a user during a wide range of operations. For example, when the working machine 142 is operating near a linear barrier, e.g. a wall, the cab 154, superstructure 150 and working arm 156 can be rotated relative to each other such that the working arm 156 is to the front of the machine 142 but offset to one side, permitting operation close to the wall and the cab 156 can be rotated towards the region to be dug to improve visibility.

The working machine 142 includes a counterweight 160 having a mass for counterbalancing the working arm 156. The counterweight 160 is provided on the superstructure 150. The counterweight 160 is provided on the superstructure 150. The counterweight 160 may be formed as a single unitary component, for example a cast iron or steel component. In alternative arrangements of a working machine, it will be appreciated that the counterweight may be omitted.

An apparatus 110 for removing material from a surface 111 that is to be repaired is mounted to the working arm 156. The working arm 156 is configured to connect to the mounting arrangement 140 of the apparatus 110. The working arm 156 includes a first implement mount for connecting a working implement, e.g. the apparatus 110, to the working arm 156. In the illustrated arrangement, the first implement mount includes a hitch for securing the apparatus 110 onto the working arm 156. In the illustrated arrangement, the hitch is provided in the form of a tiltrotator 158, and the apparatus 110 connects to the apparatus tiltrotator 158. In alternative arrangements, a different attachment arrangement may be provided to connect the working arm 156 to the mounting arrangement 140 of the apparatus 110, e.g. via an alternative hitch or via a direct connection.

The superstructure 150 also includes a first auxiliary hydraulic connector 180 configured to supply hydraulic fluid to the apparatus 110. In the illustrated arrangement, the first auxiliary hydraulic connector 180 is provided on the working arm 156, and is configured for supplying hydraulic fluid to the apparatus 110.

Figure 8:
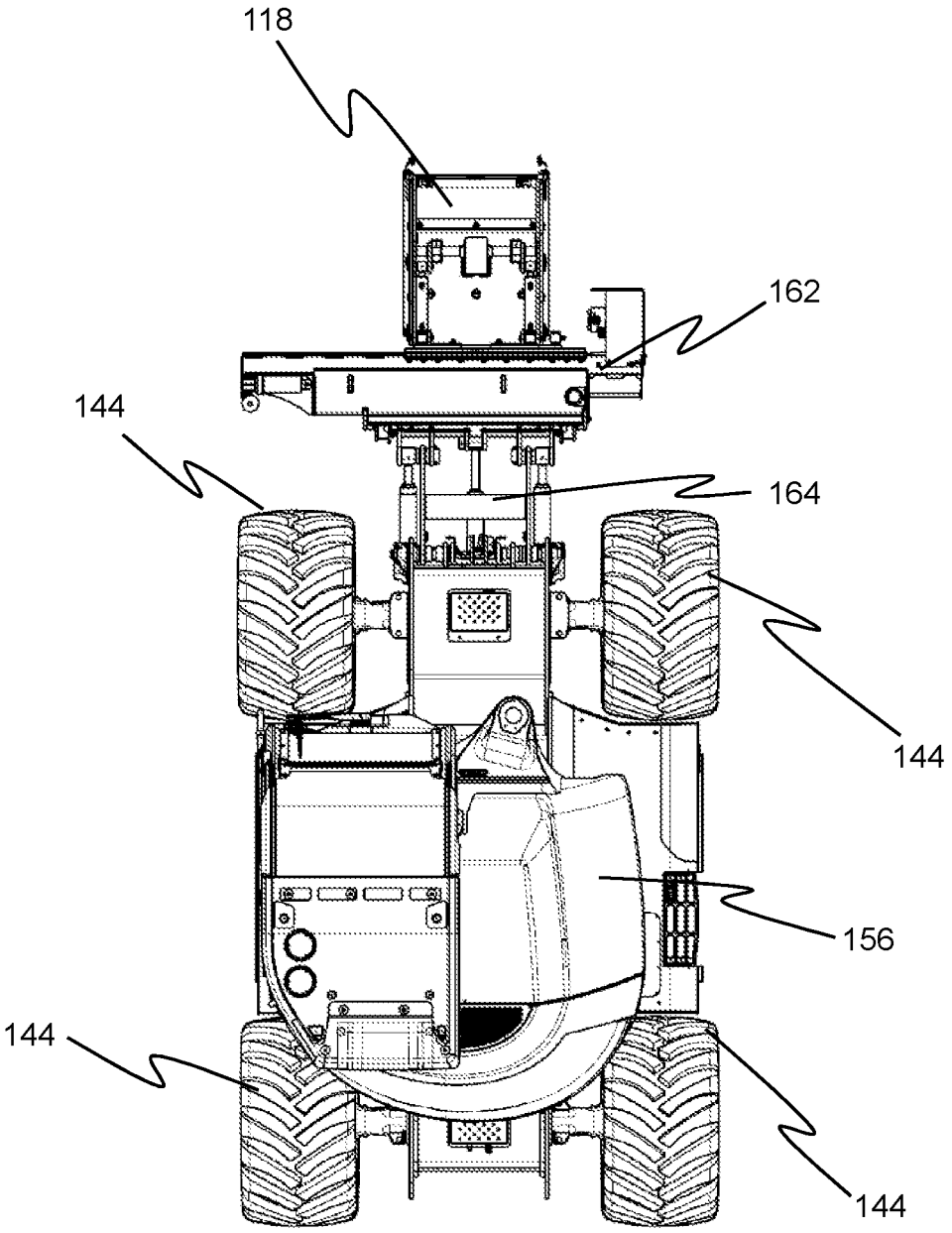
FIG. 8 is a schematic plan view of the working machine of FIG. 7.
Figure 9:
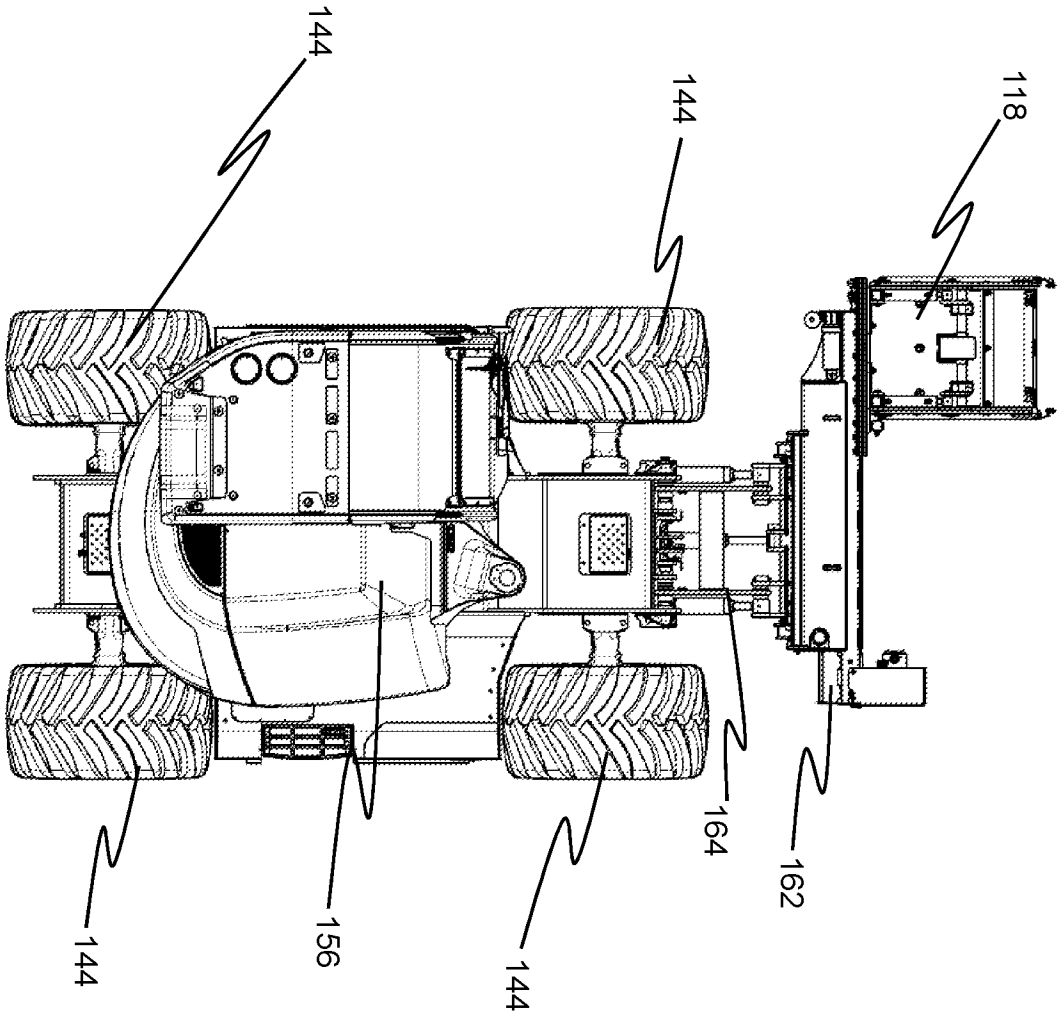
FIG. 9 is a schematic plan view of the working machine of FIG. 7.
Figure 10:
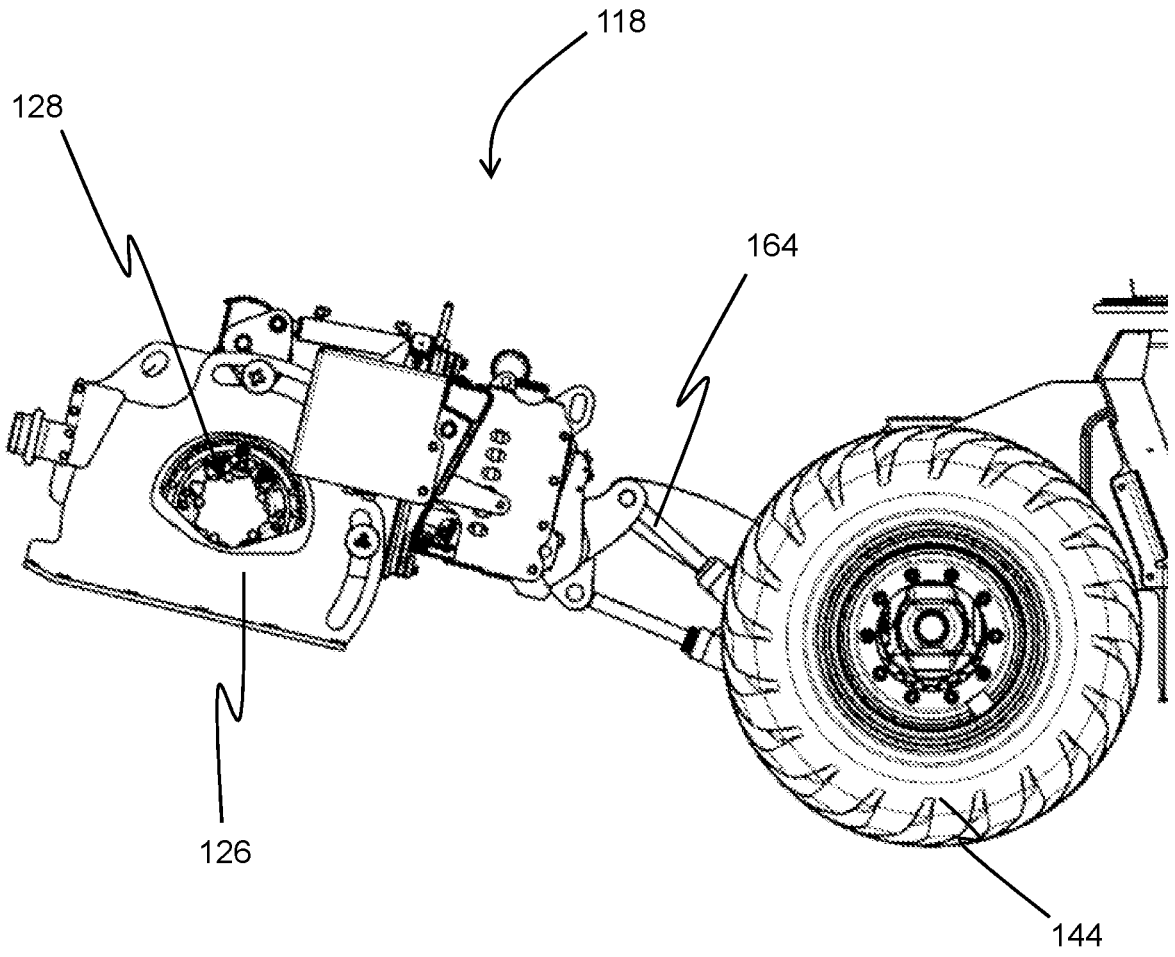
FIG. 10 is a schematic side view of a milling device of the working machine of FIG. 7.

Referring now to FIGS. 8 to 10, a milling device 118 is mounted to the undercarriage 148 and is configured for breaking up, e.g. milling, a surface 111 to loosen the surface material. It will be appreciated that the milling device 118 may be configured to break up a surface 111 down to a depth of approximately 40 mm, or down to a depth of approximately 120 mm, or down to a depth of approximately 160 mm, as required. When the surface 111 has been broken up by the milling device 118, the loose surface material is left in place as loose debris. The loose material is subsequently collected.

The milling device 118 defines an elongate axis that is illustrated as being substantially perpendicular to the elongate axis of the apparatus 110. It will be appreciated that the milling device 118 may be mounted to the frame 112 such that the elongate axis of the milling device pivotable/adjustable relative to the elongate axis of the frame 112. Put another way, it will be appreciated that the milling device 118 may be connected to the frame 112 such that it is able to swivel relative to the frame 112. The milling device 118 is attached to a second implement mount 162 at the front of the working machine 142. The undercarriage 118 is provided with a hydraulic connector (not shown) for supplying hydraulic fluid to a actuators for actuating the working implement, e.g. the milling device 118, attached to the second implement mount 162.

In order to improve the functionality of the working machine 142, the undercarriage 148 is provided with a second auxiliary hydraulic connector for connecting to the milling device 118. The second auxiliary hydraulic connector is configured to supply hydraulic fluid to the milling device 118 to actuate a function of the milling device 118. The second auxiliary hydraulic connector is provided on the same side of the undercarriage 148 as the second implement mount 162.

Although not illustrated, the working machine 142 may further include a third auxiliary hydraulic connector for connecting auxiliary working implements thereto. The third auxiliary hydraulic connector may be configured to supply hydraulic fluid to an implement attached to a third implement mount (not shown) to actuate a further function of the implement. The third auxiliary hydraulic connector may be provided one the same side of the undercarriage 148 as the third implement mount.

The second implement mount 162 is provided with a standardized interface configuration to enable a range of auxiliary implements to be connected thereto. Put another way, the second implement mount 162 is provided with a skid-steer loader implement interface configuration. This arrangement helps to improve the functionality of the working machine. Providing an undercarriage 148 having a standardized interface configuration for connecting working implements thereto as well as having one or more auxiliary hydraulic connectors has been found to improve the versatility and functionality of the working machine 142. The milling device 118 is mounted on the second implement mount 162 so as to be movable laterally along the second implement mount 162. Although not illustrated, the working machine 142 includes an actuator configured to move the milling device 118 laterally along the second implement mount 162.

As discussed above, the cab 154 is offset to a first side of the superstructure 150 in a lateral direction. The milling device 118 is moveable along the second implement mount 162, e.g. from a substantially central position, in a direction towards the first side of the working machine 142.

The second implement mount 162 is configured and arranged so as to enable the milling device 118 to be positioned so as to extend beyond the ground engaging structure 144. Put another way, the second implement mount 162 is configured and arranged so as to enable the milling device 118 to be positioned so as to extend beyond the foot print of the working machine 142. In the present arrangement, the second implement mount 162 is configured such that the milling device 118 is able to be positioned by a distance in the range 25 mm to 75 mm, e.g. of approximately 50 mm past an outer edge of the ground engaging structure 144.

In the arrangement shown, the milling device 118 is provided in the form of a planer. The planer 118 includes a planer housing 126 and a milling drum 128 for breaking up the surface 111. It will be appreciated that in alternative arrangements, any device suitable for breaking up the surface 111 may be used. A laterally outer side surface of the housing 126 is substantially planar. Put another way, the laterally outer side surface of the housing 126 is devoid of any surface features.

The undercarriage 148 includes a first actuator 164 for raising and lowering the milling device 118. The second implement mount 162 is configured such that the milling device 118 is able to raised and lowered whilst retaining a substantially constant orientation, or may be pivotally raised and lowered.

Figure 11:
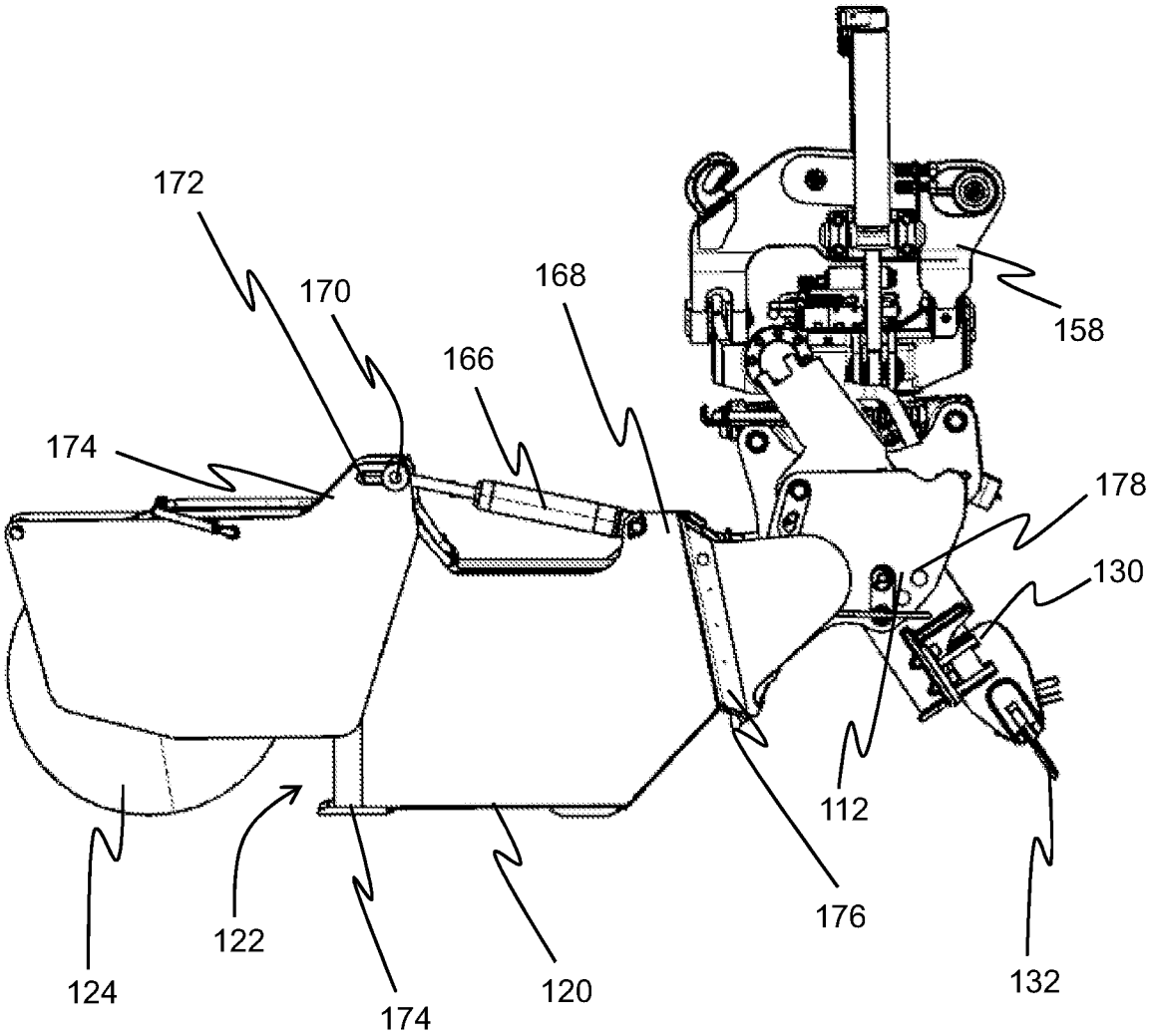
FIG. 11 is a schematic side view of an apparatus of the working machine of FIG. 7.

Referring now to FIG. 11, the apparatus 110 includes a mounting arrangement 140. The mounting arrangement is provided in the form of a frame or bracket 112. The apparatus 110 includes a collector 120. The collector 120 is connected to the frame 112. The collector 120 defines a first opening 122 at or near the trailing end of the frame 112 for receiving material/debris therein.

The apparatus 110 includes a sweeper 124. The sweeper 124 is connected to the collector 120. The sweeper 124 is positioned to trail the collector 120 in a preferred direction of operation of the apparatus 110 (i.e. the sweeper 124 is positioned rearward of the collector 120 on the apparatus 110). The sweeper 124 is configured and arranged to sweep material of a surface 111 into the collector 120 via the first opening 122. Although the apparatus 110 has been discussed as containing a sweeper in the form of a brush, it will be appreciated that in alternative arrangements the sweeper 124 may be provided as any suitable arrangement for moving material from the surface 111 to the collector 120, such as a suction arrangement, a scoop, or any other suitable arrangement.

The sweeper 124 is adjustably mounted to the collector 120 so as to be moveable between a first position for engaging a surface and a second position spaced apart from the first opening. The sweeper 124 is connected to the collector 120 via an actuator 166 configured to move the sweeper between the first and second positions. Through this arrangement, the sweeper 124 is able to be moved away from the first opening 122 such that the collector 120 is able to be moved by the working arm so as to be operated as a shovel to collect large volumes of material from the surface 111.

The actuator 166 has a first end 168 that is fixedly attached to the collector 120. The actuator 166 has a second end 170 slideably mounted within an elongate slot 172 on the sweeper 124. The elongate slot 172 is provided on a pair of opposing brackets 174 of the sweeper 124. Through the provision of the mounting slot 172, the sweeper 124 is able to move relative to the collector 120, for example when the sweeper 124 is moved into contact with the surface 111.

The apparatus 110 is mounted to the working arm 156. The apparatus 110 is mounted to the working arm 156 via a standardized interface configuration 176. Put another way, the apparatus 110 is mounted to the working arm 156 via a skid-steer loader implement interface configuration. In the illustrated arrangement, the frame 112 (i.e. the mounting arrangement 140) includes the standardized interface configuration.

The apparatus 110 is provided with a cutting device 130 mounted to the frame 112. The cutting device 130 defines a substantially straight cutting edge 132. This substantially straight cutting edge 132 is provided for cropping an external perimeter of the area of a surface 111 broken up by the milling device 18. Put another way, the cutting device 130 defines a substantially straight cutting or cropping edge 132. In the arrangement, shown the cutting device 130 is provided in the form of a chisel mounted to the frame 112, but it will be appreciated that in alternative arrangements any suitable cutting tool may be used to suit the application.

Use of the cutting device 130 enables an operator to provide a defined edge to the area the surface 11 that has been machined. The provision of a defined boundary (e.g. a substantially upright boundary) between older/existing material and subsequently deposited new surface material has been found to improve retention of the new surface material.

The width of the cutting device 130 may be provided so as to substantially match the width of the milling device 118 (e.g. of the milling drum 128 of the milling device 18).

The cutting device 130 is mounted to the frame 112 via an actuator 314. The actuator 134 is configured and arranged to move the cutting device 130 towards the surface 111 with sufficient force to break through the surface 111. In alternative arrangements, the actuator may not be provided and the cutting device 130 may be directly connected to the frame 112. In such alternative arrangements, it will be appreciated that the cutting device 130 may be driven towards a surface 111 by the working arm 156 so as to crop an external perimeter of the area of a surface 111 broken up by the milling device 118.

The cutting device 130 is adjustably mounted to the frame 112. This pivotal and/or rotational mounting enables the position of the cutting device 130 to be adjusted relative to the frame 112. The cutting device 130 is adjustably mounted so as to be moveable between a deployed position and a transport position. The working machine 142 may comprise a locking arrangement 178 to lock the cutting device in the deployed or transport position.

Whilst not illustrated, it will be appreciated that the apparatus 110 may be provided with a dust suppression arrangement. As an example, this may be provided in the form of a water tank mounted on the apparatus 110 along with a pump to dispense water from a nozzle (e.g. in the form of a spray nozzle or dribble bars). The nozzle may be provided on the sweeper 124. It will be appreciated that the water tank and water pump may be positioned on the working machine.

Whilst the embodiment of FIGS. 7 to 11 has been discussed with reference to the apparatus 110 mounted on the first implement mount of the working arm 156 and the milling device 118 being mounted on the second implement mount 162, it will be appreciated that in some arrangements the milling device 118 may be connected to the working arm 156 and the apparatus 110 may be connected to the body 146 or undercarriage 148.

Although the teachings have been described above with reference to one or more preferred embodiments, it will be appreciated that various changes or modifications may be made without departing from the scope as defined in the appended claims.

The invention claimed is:

1. A working machine comprising:

a ground engaging structure provided in the form of front and rear wheels or a pair of endless tracks;

a body supported on the ground engaging structure;

a first working arm for performing work functions, the first working arm comprising a first implement mount at a distal end thereof;

an apparatus for removing material from a surface mounted to the first implement mount, the apparatus comprising a frame defining a leading end and a trailing end in a preferred direction of operation of the apparatus, a milling device connected to the frame and configured to break up a surface, in use, a collector connected to the frame, the collector trailing the milling device in a preferred direction of operation of the apparatus, and having a first opening at or near the trailing end of the frame, and a sweeper connected to the frame, the sweeper trailing the collector in the direction of operation of the apparatus, wherein the sweeper is configured and arranged to move surface material broken up by the milling device into the collector via the first opening.

2. The working machine according to claim 1, wherein the apparatus is configured such that the milling device and sweeper are operated simultaneously.

3. The working machine according to claim 1, wherein the collector and the sweeper are moveable relative to the milling device.

4. The working machine according to claim 1, comprising a cutting device connected to the frame, the cutting device defining a cutting edge.

5. An apparatus according to claim 1, wherein the milling device comprises a planer rotatably connected to a housing.

6. The working machine according to claim 1, wherein the sweeper comprises a rotatable sweeper brush, and wherein the sweeper brush is configured and arranged to extend below the collector.

* * * * *